US007032681B1

(12) United States Patent
Sprakel

(10) Patent No.: US 7,032,681 B1
(45) Date of Patent: Apr. 25, 2006

(54) DEVICE FOR EXTINGUISHING A FIRE

(75) Inventor: Dirk K. Sprakel, Köln (DE)

(73) Assignee: FOGTEC Brandschutz GmbH & Co. KG, Köln (DE)

( * ) Notice: Subject to any disclaimer, the term of this patent is extended or adjusted under 35 U.S.C. 154(b) by 0 days.

(21) Appl. No.: 10/089,924

(22) PCT Filed: Sep. 30, 2000

(86) PCT No.: PCT/EP00/09604

§ 371 (c)(1),
(2), (4) Date: Aug. 6, 2002

(87) PCT Pub. No.: WO01/24881

PCT Pub. Date: Apr. 12, 2001

(30) Foreign Application Priority Data

Oct. 7, 1999 (DE) ..... 199 48 324

(51) Int. Cl.
*A62C 37/14* (2006.01)

(52) U.S. Cl. ..... 169/58; 169/16; 169/54; 169/58; 169/62

(58) Field of Classification Search ..... 169/9, 169/16, 56, 37, 54, 58, 62, 11
See application file for complete search history.

(56) References Cited

U.S. PATENT DOCUMENTS

| | | | | | |
|---|---|---|---|---|---|
| 2,419,826 | A | * | 4/1947 | Dodelin et al. | 169/11 |
| 3,682,388 | A | * | 8/1972 | Ferguson | 169/9 |
| 4,126,184 | A | * | 11/1978 | Hinrichs | 169/56 |
| 4,326,589 | A | | 4/1982 | Ballman | |
| 5,660,236 | A | | 8/1997 | Sears et al. | |
| 5,697,450 | A | | 12/1997 | Stehling et al. | |
| 5,713,417 | A | | 2/1998 | Sundholm | |
| 5,967,239 | A | * | 10/1999 | Sprakel et al. | 169/37 |
| 6,095,251 | A | * | 8/2000 | Mitchell et al. | 169/54 |
| 6,112,822 | A | | 9/2000 | Robin et al. | |

FOREIGN PATENT DOCUMENTS

| | | |
|---|---|---|
| CA | 2194525 | 7/1997 |
| DE | 26 35 076 A1 | 2/1978 |
| DE | 2635076 A | 2/1978 |
| DE | 34 40 901 A1 | 7/1985 |
| EP | 0046378 | 2/1982 |
| EP | 0 750 924 A1 | 1/1997 |
| JP | 02019177 A | 1/1990 |
| TW | 141828 | 9/1990 |

(Continued)

OTHER PUBLICATIONS

"Fire Protection Handbook," 18th Ed., Arthur R. Cote, Jim L. Linville, editors, National Fire Protection Association, Quincy, MA, pp. 6–199 to 6–206 (1997).
English translations of R.O.C. and PRC Office Actions dated May 1, 2001, Oct. 19, 2002, Apr. 18, 2003, Dec. 4, 2003, May 21, 2004.

*Primary Examiner*—Steven J. Ganey
(74) *Attorney, Agent, or Firm*—Proskauer Rose LLP

(57) ABSTRACT

With a device for extinguishing a fire, with extinguishing nozzles (10) arranged in areas of a structure, and of a building or a ship in particular, said extinguishing nozzles being connected in each case to a connection end (7*a*) of a supply line (7) filled with extinguishing fluid, said supply line connecting the extinguishing nozzles (10) to an extinguishing fluid supply device, which in the event of a fire imposes on the supply line (7) extinguishing fluid under pressure, simple and economical means allow for a reliable response, in that a bursting disk (33) is arranged in the area of the connection end (7*a*) of the supply line (7), which bursts at the attaining of a predetermined bursting pressure of the extinguishing fluid in the supply line (7), so that extinguishing fluid flows unimpeded into the extinguishing nozzle (10), and in which the supply line (7) in the position of rest is filled with extinguishing fluid at a pressure of rest which is lower than the bursting pressure.

7 Claims, 3 Drawing Sheets

FOREIGN PATENT DOCUMENTS

| | | |
|---|---|---|
| TW | 186753 | 7/1992 |
| TW | 323519 | 12/1997 |
| WO | 95/00205 | 1/1995 |
| WO | 96/33775 | 10/1996 |
| WO | 97/39804 | 10/1997 |
| WO | 98/04322 | 2/1998 |

* cited by examiner

DEVICE FOR EXTINGUISHING A FIRE

BACKGROUND OF THE INVENTION

The invention relates to a device for the extinguishing of a fire with extinguishing nozzles arranged in areas of a structure, in particular of a building or a ship, said nozzles being connected in each case to a connection end of a supply line filled with extinguishing fluid, said supply line connecting the extinguishing nozzles to an extinguishing fluid supply device which, in the event of a fire, imposes extinguishing fluid under pressure onto the supply line.

Such systems are known for fighting fires in buildings. The supply line is at least in part filled with extinguishing fluid under pressure even in the position of rest. The supply line or the extinguishing nozzles connected to the supply line are equipped with valves, which avoid the unintentional escape of extinguishing fluid in the position of rest. In the event of a fire the valves open automatically or are remotely controlled by an actuator device, with the result that extinguishing fluid can be emitted from the extinguishing nozzles.

With these systems the extinguishing nozzles can be designed in such a way that the extinguishing nozzles are fitted with open nozzle inserts, which can be connected to the supply line by means of channels formed in the extinguishing nozzles. These nozzle inserts can be designed in such a way that, when subjected to an extinguishing fluid under high pressure, an extinguishing mist is generated by the nozzles.

An advantage with filled systems of this type is that the volume of the filled supply line is fully used for the storage of the extinguishing fluid. In this way it is possible, in particular with such systems in which the supply of extinguishing fluid is effected by means of stored pressure energy, for the stored energy available and the capacity of the pressure vessels to be exploited with optimum effect. This makes it possible for smaller pressure vessels to be used, which in turn achieves savings in costs and spatial requirements.

In comparison with unfilled systems, in which the supply line is empty in the state of rest, and is only filled in the event of a fire with extinguishing fluid from the extinguishing fluid supply, the filled systems offer the advantage that the time required with unfilled systems for the supply line to be filled is not a consideration. With filled systems, the extinguishing fluid emerges directly after the valves are opened, as a result of which the response time of the system is shortened in the event of a fire alarm, and the fire is prevented from spreading any further.

Finally, with systems fitted with extinguishing fluid under pressure, pumps and pressurised containers can be used which are less high-performing and less elaborate in comparison with unfilled systems, which in the event of a fire only increase the pressure prevailing in the supply line to the pressure needed for extinguishing. This advantage becomes particularly apparent in systems in which extinguishing fluid is deployed under high pressure in order to create an extinguishing mist.

A disadvantage with the systems described, however, is the considerable expenditure for manufacture, installation, and maintenance for the valve devices used with these systems, and for the actuation systems for the valves which may be required. In addition to this, the risk pertains that the valves may fail in the event of a fire, rendering the fighting of the fire impossible.

The object of the invention is to create a device of the type described in the preamble with simple and economical means, which will render a reliable response possible.

SUMMARY OF THE INVENTION

This object is achieved according to the invention in that, with such a device, a bursting disk is arranged in the area of the connection end of the supply line, said bursting disk bursting when a predetermined bursting pressure of the extinguishing fluid in the supply line is reached, with the result that the extinguishing fluid flows unimpeded into the extinguishing nozzle, and that the supply line, in the state of rest of the device, is filled with extinguishing fluid at a pressure of rest which is lower than the bursting pressure.

In a device according to the invention, the supply lines are filled with extinguishing fluid. The flow of extinguishing fluid to the inherently open extinguishing nozzles is in this situation closed off in the state of rest by a bursting disk, which is arranged in the area of the connection end of the connection line allocated to the individual extinguishing nozzles in each case. In this way, by the use of a simple and economical bursting disk, the invention exploits the advantages of a filled system for fighting fires, as well as enabling the reliable response of the device. Thus, a system for fire fighting designed in accordance with the invention features short reaction times, since in the state of rest the extinguishing fluid is already located in immediate proximity to the extinguishing nozzles, and the distance to be covered by the fluid to the nozzles is short.

In addition to this, by doing without valves and the actuation system for them that might be required, the reliability of the device is perceptibly increased. By contrast with valves, the bursting disks used according to the invention cannot become jammed. Since the use of bursting disks also means that an actuation mechanism can be done away with, there is also no risk any longer of these failing.

In addition to this, the use of bursting disks is, as a rule, more economical than that of valves.

To advantage, the nozzle inserts used in a device according to the invention generate an extinguishing mist. With such an extinguishing mist, a fire can be effectively fought with a small quantity of extinguishing medium. The pressures of the extinguishing fluid required for the creation of such a mist amount to up to 300 bar.

For preference, the pressure at rest of the extinguishing fluid is equal to the ambient pressure. In this way, the expenditure can be avoided which is always required with known filled systems for the maintaining of the pressure at rest.

As an alternative, in order to monitor leaks, the pressure at rest of the extinguishing fluid can be higher than that of the ambient pressure, but lower than the bursting pressure. In this way, a pressure drop, and therefore a leak in the filled supply line, can be detected, for example by means of a pressure sensor arranged in the filled supply line, said sensor detecting the pressure drop in the supply line incurred as a result of a leak.

BRIEF DESCRIPTION OF THE DRAWINGS

Depending on the individual local conditions, it may also be to the purpose if several extinguishing nozzles are connected to the connection end of the supply line by means of a branching element. With this embodiment of the invention, in the state of rest the flow of extinguishing fluid to more than one extinguishing nozzle is closed off simultaneously by means of a bursting disk. This is particularly to the purpose if, in the event of fire, extinguishing nozzles need to be provided simultaneously with extinguishing fluid for the protection of a particular building or a specific area. If necessary, in this situation the extinguishing nozzles can in each case be connected by means of an intermediate line to the branching element, in order to be able to guarantee the plane or spatial coverage of a specific section.

The invention is explained hereinafter in greater detail on the basis of drawings showing an embodiment. These show:

FIG. 3 an extinguishing nozzle used in one of the devices according to

FIGS. 1 or 2, in a partially exploded side view.

DETAILED DESCRIPTION OF THE INVENTION

The device for the extinguishing of a fire features an extinguishing fluid supply 2, which contains a fluid container and a high-pressure pump, not individually shown. As an alternative, the extinguishing fluid supply 2 can also be equipped with one or more pressure reservoirs, in which extinguishing fluid is stored under pressure. In addition, the extinguishing fluid can be stored under ambient pressure, and subjected to pressure from one or more pressure reservoirs only in the event of activation. The extinguishing fluid supply 2 is controlled by a control device 3, which receives the fire alarm signal from a fire monitor device 4.

Figure 1:
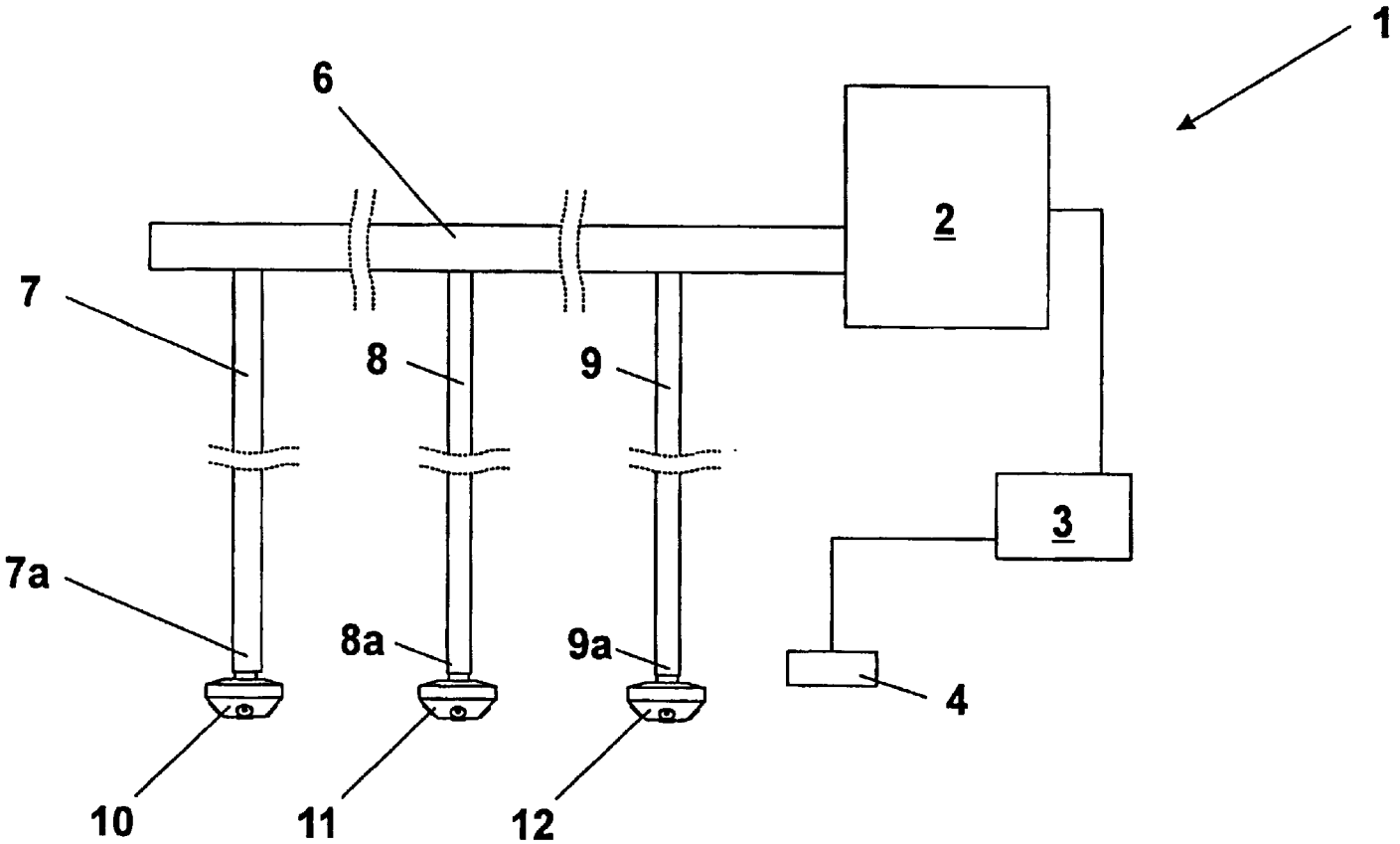
FIG. 1 a device for extinguishing a fire in a schematic representation.

In the embodiment according to FIG. 1, extinguishing nozzles 10, 11, 12 are connected to the extinguishing fluid supply 2 by means of a main supply line 6 and individual supply lines 7, 8, 9, each branching off from the main supply line 6.

Figure 2:
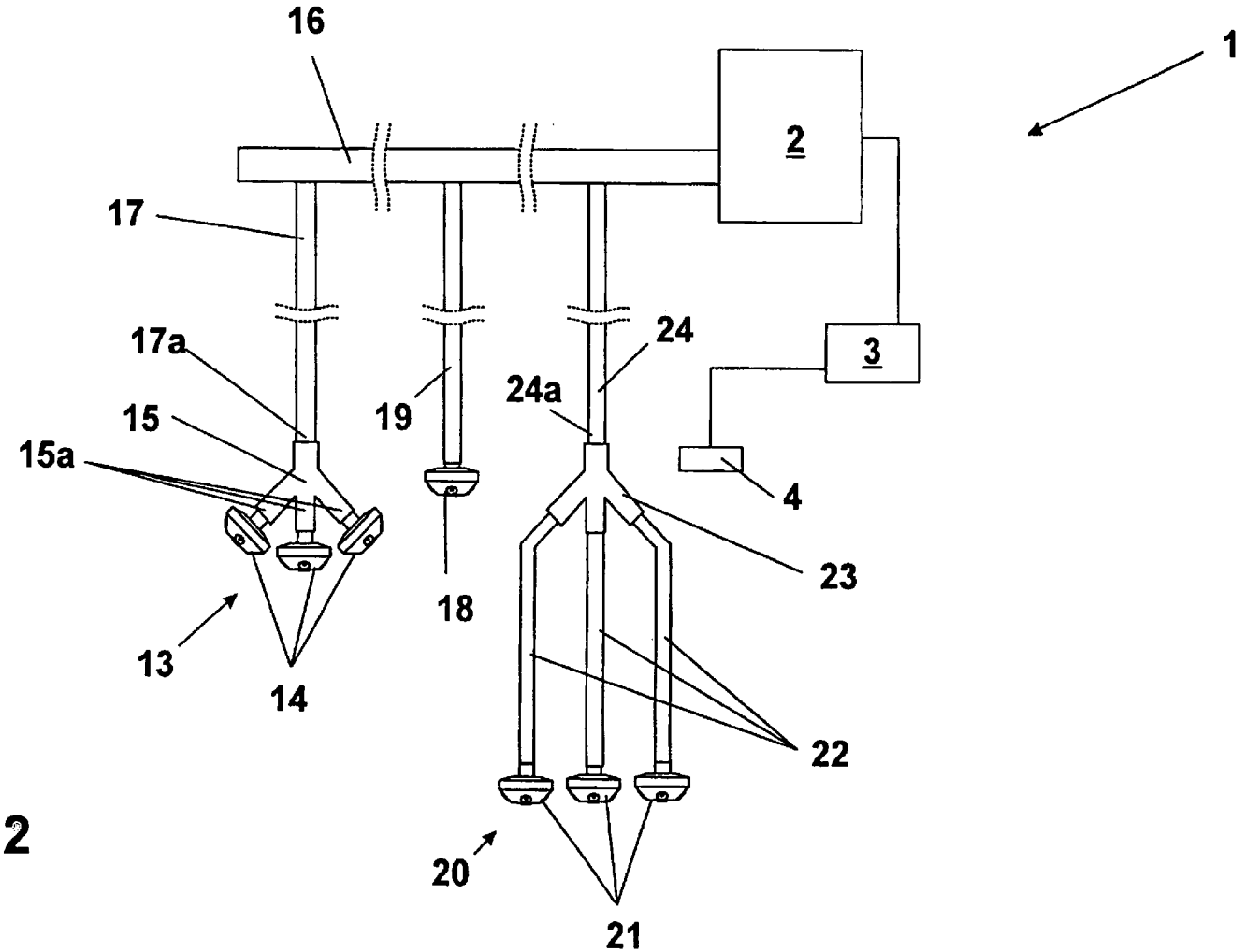
FIG. 2 a variant of the device according to FIG. 1.

In the embodiment according to FIG. 2, a first group 13 of three extinguishing nozzles 14 is connected by means of a branching element 15 to a supply line 17 departing from a main supply line 16. In addition to this, an individual extinguishing nozzle 18 is connected directly to a supply line 19, which likewise departs from the main supply line 16. With a third group 20 of three extinguishing nozzles 21, the extinguishing nozzles 21 are finally connected via intermediate lines 22 and a branching element 23 to a third supply line 24, departing from the main supply line 16.

Figure 3:
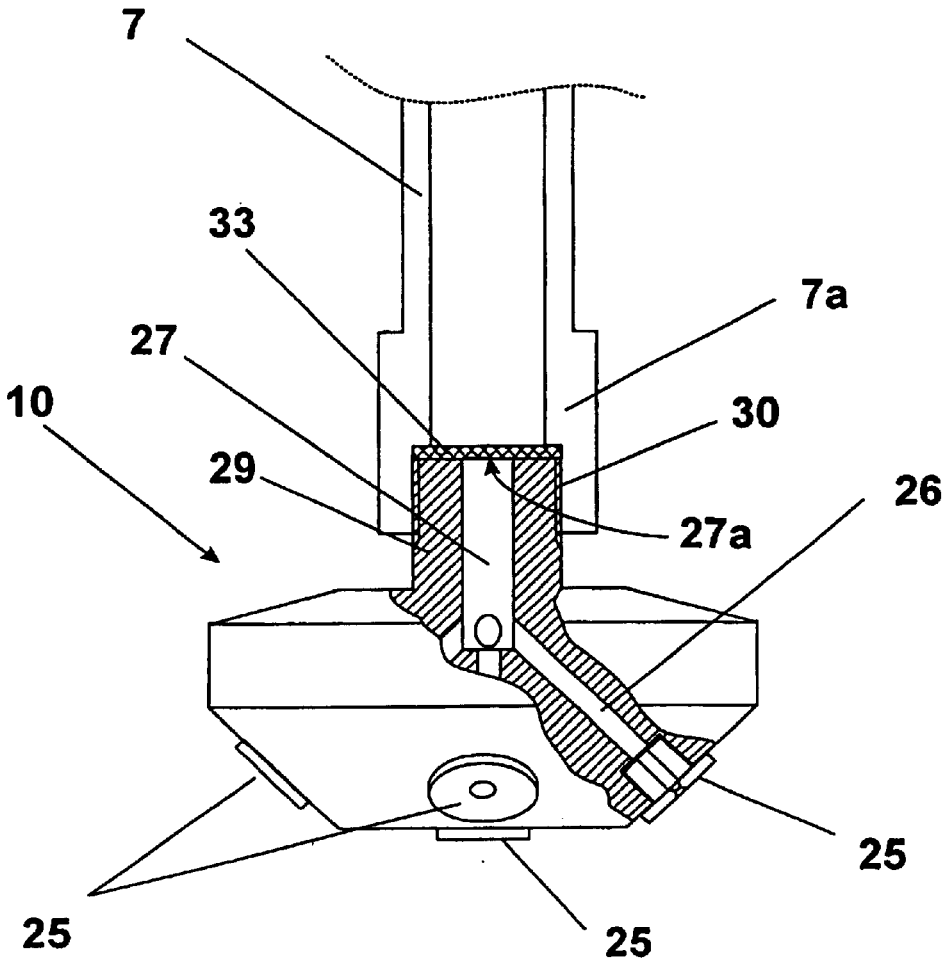

Each of the extinguishing nozzles 10, 11, 12, 14, 18, 21 is designed in the same way as the extinguishing nozzle 10 shown by way of example in FIG. 3. Accordingly, all the extinguishing nozzles 10, 11, 12, 14, 18, 21 feature open nozzle inserts 25, which are connected via channels 26 formed in the individual extinguishing nozzle to an inflow borehole 27 of the extinguishing nozzle. The inflow borehole 27 opens on the front face of a shoulder element 29, which is provided with an external thread 30. The nozzle inserts 25, when subjected to an extinguishing fluid under high pressure of up to 300 bar, generate a finely distributed extinguishing mist.

The external thread 30 of the shoulder element 29 of the extinguishing nozzles 10, 11, 12, 18 is screwed into a corresponding internal thread on the respective connection end 7*a*, 8*a*, 9*a* of the supply lines 7, 8, 9 and 19 respectively, while the external thread 30 of the shoulder elements 29 of the extinguishing nozzles 14 are in each case screwed into a corresponding internal thread, not shown here, on the respective connection ends 15*a* of the branching element 15. Accordingly, the extinguishing nozzles 21 are connected to the connection end of the intermediate line 22 allocated to them.

With the extinguishing nozzles 10, 11, 12, 18, as shown in FIG. 3, in the state of rest of the device 1, the inlet aperture 27*a* of the inflow borehole 27 is closed off by means of a bursting disk 33, which is located in the connection end 7*a* of the individual supply line 7, 8, 9 and 19 respectively. A corresponding bursting disk, not shown here, is located in the individual connection end 17*a* or 24*a* respectively of the supply line 17 and 24, and in the state of rest of the device 1 keeps the inflow closed off of the branching element 15 or of the branching element 23 respectively.

In this state of rest of the device 1, the main supply line 6 (FIG. 1) and 16 (FIG. 2) respectively, and the supply lines 7, 8, 9 (FIG. 1) or 17, 19, 24 (FIG. 2) respectively, departing from it, are filled with extinguishing fluid, such as water, for example. In this situation a pressure at rest prevails in th e pipeline system filled with extinguishing fluid and formed by the main supply line 6 or 16 respectively and the supply lines 7, 8, 9 and 17, 19, 24 respectively departing from it, said pressure at rest corresponding approximately to the ambient pressure.

The fire monitor 4 monitors a room, a specific area, or a specific building for the outbreak of fire. In the event of a fire breaking out, the fire monitor 4 issues a fire alarm signal to the control device 3. This then causes the extinguishing fluid supply system 2 to impose extinguishing fluid, kept under pressure, on the main supply line 6 or 16 respectively, and the supply lines 7, 8, 9 and 17, 19, 24 respectively departing from them.

As soon as the pressure of the extinguishing fluid present at the individual bursting disk 33 rises above the bursting pressure of the bursting disk 33 concerned, the bursting disk 33 bursts. Once the individual bursting disk 33 has burst, extinguishing fluid flows unimpeded into the extinguishing nozzles 10, 11, 12, 18, or is likewise distributed un impeded via the branching elements 15, 23 to the extinguishing nozzles 14 or 21 respectively. The extinguishing fluid flowing in such way into the extinguishing nozzles 10, 11, 12, 14, 18, 21 emerges as extinguishing mist from the nozzle inserts 25 of the extinguishing nozzles.

It is self-explanatory that, as an alternative to the foregoing embodiment examples, it is also possible to arrange at the extinguishing nozzles 14, 21 of the groups 13 and 15, in the embodiment according to FIG. 2, a bursting disk immediately upstream of the individual extinguishing nozzles 15 or 21 respectively. The embodiment described here is always to the purpose if the distance interval between the extinguishing nozzles 14, 21 is in each case shorter in comparison with the other line lengths, so that on the one hand the expenditure for the installation of the bursting disk is minimised and, on the other, the time for the filling of the branching elements and intermediate pipes, which are empty in the state of rest, is nevertheless short.

Reference Designation List

Extinguishing device
Extinguishing fluid supply
Control device
Fire monitor
Main supply line
7,8,9 Supply lines
7*a*,8*a*,9*a* Connection ends of supply line 7,8,9
10,11,12 Extinguishing nozzles
13 Group of three extinguishing nozzles 14

14 Extinguishing nozzle
15 Branching element
15*a* Connection ends of the branching element 15
16 Main supply line
17 Supply line
17*a* Connection end of the supply line 17
18 Extinguishing nozzle
19 Supply line
20 Group of three extinguishing nozzles 21
21 Extinguishing nozzle
22 Intermediate lines
23 Branching element
24 Supply line
24*a* Connection end of the supply line 24
25 Open nozzle inserts
26 Channels
27 Inflow borehole
27*a* Inlet aperture of the inflow borehole 27
29 Shoulder element
30 External thread
33 Bursting disk

What is claimed is:

1. A device for extinguishing fires comprising:

extinguishing nozzles arranged in areas of a structure;

a supply line filled with extinguishing fluid;

an extinguishing fluid supply device; and a bursting disk, wherein said extinguishing nozzles are connected to a connection end of the supply line connecting the extinguishing nozzles to the extinguishing fluid supply device, said fluid supply device imposing the extinguishing fluid under pressure onto the supply line in the event of fire and wherein the bursting disk is arranged about the connection end of the supply line, said bursting disk bursting when the extinguishing fluid in the supply line reaches a predetermined bursting pressure, so that the extinguishing fluid flows unimpeded into the extinguishing nozzles, wherein the extinguishing fluid fills the supply line and is at a resting pressure which is lower than the bursting pressure when the device for extinguishing fires is in a quiescent state.

2. The device according to claim 1, wherein the extinguishing nozzles feature nozzle inserts which generate an extinguishing mist.

3. The device according to claim 1, wherein the resting pressure is equal to the ambient pressure.

4. The device according to claim 1, wherein the resting pressure is greater than the ambient pressure, and the supply line comprises a pressure sensor.

5. The device according to claim 1, wherein several extinguishing nozzles are connected to the connection end of the supply line by a branching element.

6. The device according to claim 5, wherein the extinguishing nozzles are in each case connected via an intermediate line to the branching element.

7. The device of claim 1, wherein the structure comprises buildings or ships.

* * * * *